United States Patent [19]

Breslau

[11] Patent Number: 4,923,060

[45] Date of Patent: May 8, 1990

[54] VIDEO CAMERA CARRYING CASE

[75] Inventor: Steven M. Breslau, Chicago, Ill.

[73] Assignee: Sima Products Corporation, Skokie, Ill.

[21] Appl. No.: 374,279

[22] Filed: Jun. 30, 1989

[51] Int. Cl.[5] ..... B65D 85/38

[52] U.S. Cl. ..... 206/316.2; 190/102; 190/103; 190/127; 224/908

[58] Field of Search ..... 206/316.2, 523; 190/102, 103, 107, 124, 127; 224/908; 383/72, 74, 75

[56] References Cited

U.S. PATENT DOCUMENTS

| | | | |
|---|---|---|---|
| D. 250,225 | 11/1978 | Sykes | D87/5 E |
| D. 265,696 | 8/1982 | Koszegi | D3/33 |
| 515,928 | 3/1894 | Thompson | 190/104 |
| 1,320,646 | 11/1919 | Paterson | 383/72 |
| 2,197,977 | 4/1940 | Halpin | 383/74 |
| 3,958,676 | 5/1976 | March | 190/127 |
| 4,116,311 | 9/1978 | Davis | 190/127 |
| 4,176,701 | 12/1979 | Welgan | 206/316.2 |
| 4,210,186 | 7/1980 | Belenson | 150/52 J |
| 4,210,230 | 7/1980 | Weiner | 190/127 |
| 4,232,808 | 11/1980 | Gray | 206/316.2 |
| 4,260,004 | 4/1981 | Domke | 150/30 |
| 4,431,041 | 2/1984 | Leiserson | 150/57 J |
| 4,463,789 | 8/1984 | Leiserson | 150/52 J |
| 4,545,414 | 10/1985 | Baum | 150/52 J |
| 4,561,576 | 12/1985 | Lowe et al. | 224/209 |
| 4,733,806 | 3/1988 | Sloop | 206/316.2 |
| 4,739,880 | 4/1988 | Sawyer et al. | 383/72 |
| 4,805,748 | 2/1989 | Gerch | 190/103 |

*Primary Examiner*—David T. Fidei

*Attorney, Agent, or Firm*—Silverman, Cass & Singer Ltd.

[57] ABSTRACT

A video camera carrying case including a body portion for receiving a video camera having an opening for passage of the camera therethrough into the interior of the body portion. An adjustable disengageable safety strap is connnected to the body portion for restraining the camera within the body portion. The carrying case also can include a substantially deformable shroud to protect the interior of the body portion from the elements and the body portion can be constructed of a substantially deformable material which is capable of absorbing shock delivered to the body portion.

8 Claims, 2 Drawing Sheets

VIDEO CAMERA CARRYING CASE

BACKGROUND OF THE INVENTION

1. Field of the Invention

This invention relates generally to carrying cases for video cameras, and more particularly, to such a carrying case which readily provides access to the interior thereof from the top and front while restraining a camera therein and provides protection for the camera from the elements as well as against shock.

2. Description of the Prior Art

Carrying cases for video cameras are known and generally are designed as utility bags which provide limited access to the interior of the bag. Some of these utility bags include an opening in a top or side panel which includes a fastener, such as a zipper or a hook and loop type fastener to open and close the opening. Other types of utility bags include a top or side panel which is secured to the utility bag along one or more sides, which is displaceable to provide access to the interior and can include a similar type of fastener. In either event, access to the interior of such cases or bags can be inhibited by interference from the top or side panel as well as the type of fastener used.

In the known carrying cases, even if the top or side panel can be opened or displaced to provide uninhibited access to the interior of the case, no provisions are made to ensure that the camera does not fall out of the case when such panel is opened. Furthermore, opening or displacement of the top or side panel exposes the interior of the case including the camera therein to the elements.

It therefore is desirable to provide a video camera carrying case which readily provides access to a video camera or similar article positioned within the case, restrains the camera therein, and protects the camera and the interior of the case from the elements as well as from any shock which may be transmitted to the case.

SUMMARY OF THE INVENTION

The invention provides a video camera carrying case including a body portion for receiving a video camera, the case having an opening for passage of a camera therethrough into the interior of the body portion. An adjustable disengageable safety strap is connected to the body portion and positioned across a front access opening of the case for restraining a camera positioned within the body portion.

A substantially flexible shroud also can be positioned to cover and protect the interior of the body portion with a camera restrained therein. The shroud includes a drawstring for drawing the shroud closed about the camera, and the body portion can include substantially deformable cushioning material upon which the camera rests to absorb any shock which might be incurred by the body portion.

DESCRIPTION OF THE PREFERRED EMBODIMENT

Figure 1:
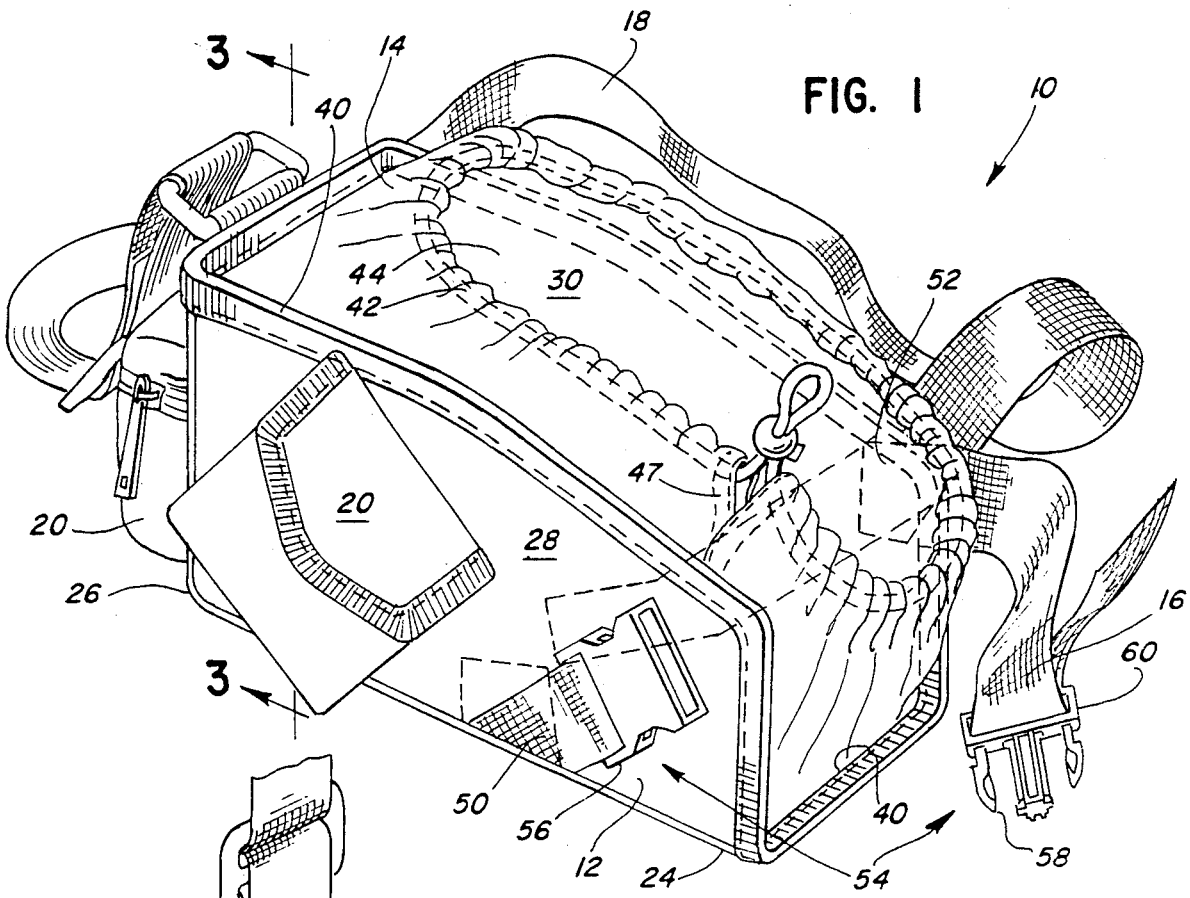
FIG. 1 is a front perspective view of the video camera carrying case of the invention shown in its open position without a camera positioned therein.
Figure 2:
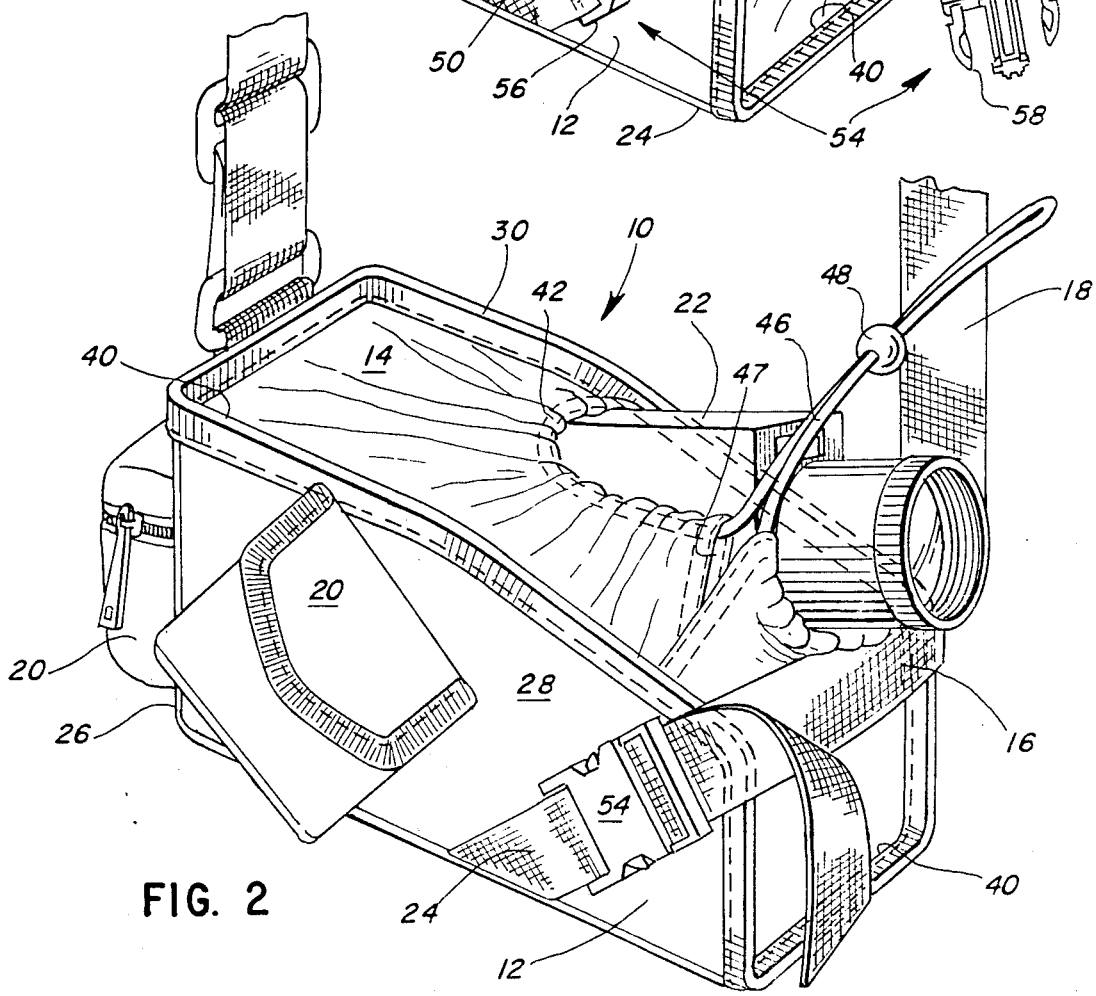
FIG. 2 is a perspective view of the video camera carrying case of FIG. 1, the same being shown in a partially closed position with a video camera positioned within the interior of the carrying case and having a portion of the video camera protruding therefrom.

Referring to FIGS. 1 and 2, the video camera carrying case of the invention is designated generally by the reference numeral 10. The carrying case 10 includes a body portion 12, a shroud 14 and a safety strap 16. If desired, an adjustable shoulder strap 18 and separate accessory compartments 20 can be included.

As FIG. 2 illustrates, the carrying case 10 preferably is used for accommodation of a video camera 22 which can be positioned within the body portion 12. It is to be understood, however, that the carrying case 10 can be used with any type of camera or similar article, or merely can be used as a general purpose carry bag, without departing from the teachings of the present invention.

Figure 3:
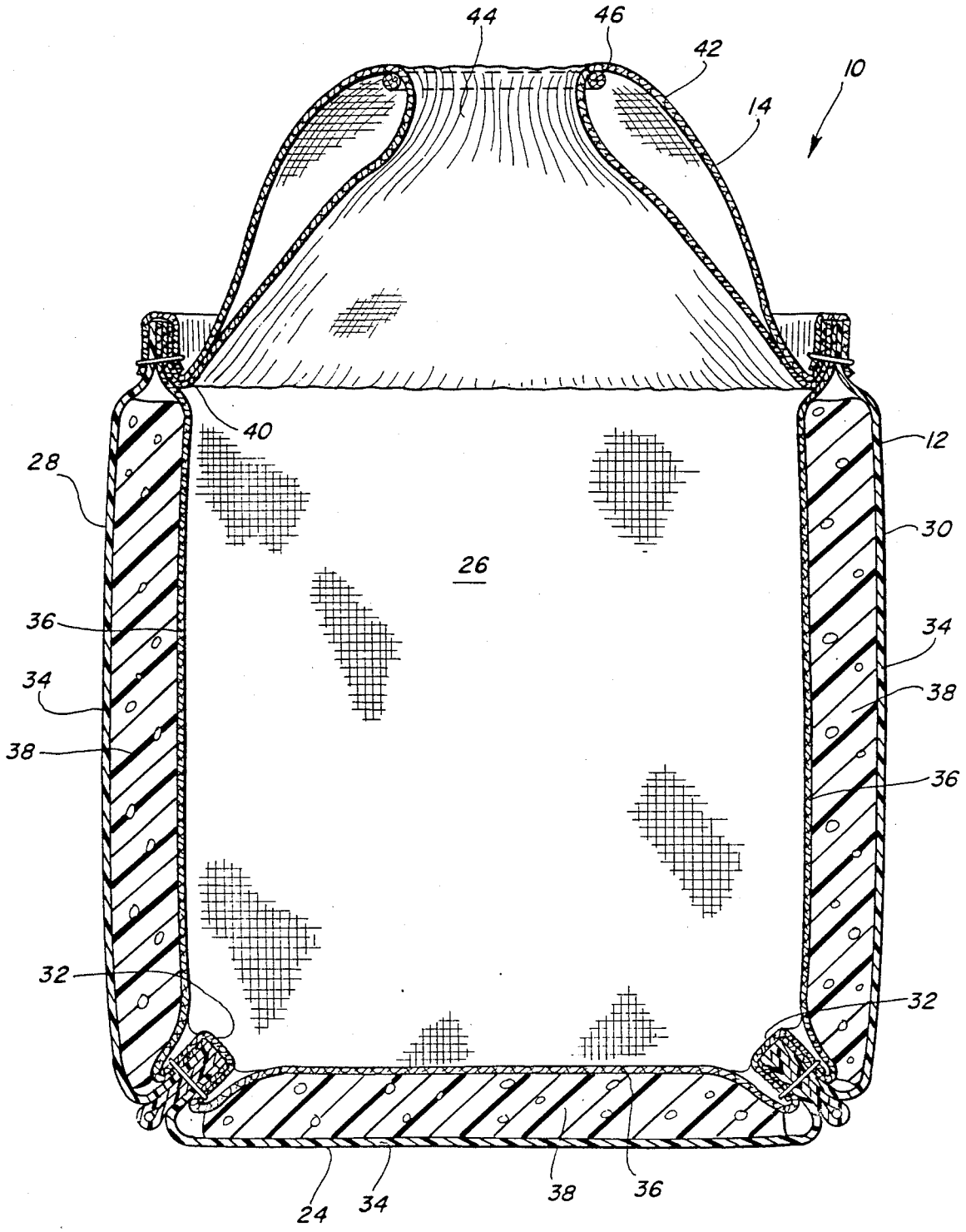
FIG. 3 is an enlarged sectional view taken along lines 3—3 of FIG. 1 in the direction indicated generally.

As FIGS. 1 and 3 illustrate, the body portion 12 preferably is substantially rectangular in shape and can include a rigid bottom panel 24, an end panel 26, a front side panel 28 and a rear side panel 30 which are connected around their peripheral edges to form the desired shape. In order to enable easy placement of a desired article within the body portion 12, the end opposite the end panel 26 and the top of the body portion 12 are left open. To further provide for easy placement of an article within the body portion 12, the front side panel 28 and rear side panel 30 can have their top corners opposite the end panel 26 cut away at an angle. Alternatively, the body portion 12 can be made in any desired shape so long as an opening is provided which is large enough to permit an article such as a video camera or the like to be easily inserted into the carrying case 10.

The panels 24, 26, 28 and 30 preferably are composed of a substantially deformable material such as fabric, vinyl, nylon, leather or the like and are sewn together around their peripheries thereby forming seams 32 to form the body portion 12. In order to enable the carrying case 10 to absorb shocks, the panels 24, 26, 28 and 30 can be double walled panels having an exterior portion 34 and an interior portion 36 which enclose a resilient insert 38 constructed of foam rubber or a similar material. The inserts 38 add rigity to the body portion 12 and should be capable of absorbing a moderate shock, such as would occur if the carrying case 10 were dropped by a user, without significantly damaging any articles restrained within the carrying case 10.

In order to protect the interior of the body portion 12 and any articles contained therein from foreign elements and to assist in restraining articles within the body portion 12, the shroud 14 is secured around the open periphery of the body portion 12. The shroud 14 preferably is made from a flexible material and is formed in a substantially cylindrical shape having a double wall including a first end 40, sewn to the bottom panel 24, end panel 26 and the side panels 28 and 30, and a second end 42 which provides an opening 44 to the exterior of the body portion 12.

In order to substantially close the opening 44 of the shroud 14, a drawstring 46 can be included between the double wall portions of the shroud 14. An opening 47 can be included in the shroud 14 to enable a portion of the drawstring 46 to extend outwardly from the shroud 14. In order to maintain the position of the drawstring 46 and the shroud 14, the drawstring 46 can include a drawstring retainer 48. Accordingly, as FIG. 2 illustrates, the drawstring 46 can be pulled through the opening 47 to draw or gather the second end 42 of the shroud 14 to substantialy close off the opening 44 which substantially closes off the top and open ends of the body portion 12.

As FIGS. 1 and 2 illustrate, to restrain the video camera 22 or similar article positioned within the body portion 12, the safety strap 16 is positioned across a portion of the open top or front end of the body portion 12, or both. The safety strap 16 preferably is formed of a flexible substantially non-elastic material and includes a first end 50 secured to the front wall panel 28 and a second end 52 secured to the rear wall panel 30.

In order to provide adjustability and to enable rapid engagement and disengagement of the strap 16 for insertion or removal of an article from the body portion 12, a releasable buckle member 54 is included between the two ends 50 and 52. As FIG. 1 illustrates, the buckle member 54 includes a female engagement portion 56 and a male engagement portion 58 which are releasably securable. The male engagement portion 58 includes a cleat or strap retaining portion 60 which provides the adjustability to the safety strap 16. Thus, the safety strap 16 can be positioned and adjusted to restrain articles within the body portion 12 by spanning the body portion 12 from the front side panel 28 to the rear side panel 30 either across the open top or open front end of the body portion 12.

In operation, with the carrying case 10 in the open position illustrated in FIG. 1, a video camera 22 is inserted within the body portion 12 either directly on top of or beneath the shroud 14. In order to restrain the camera 22 within the body portion 12, the safety strap 16 is positioned across the open top or front end of the body portion 12 and the buckle member 54 is engaged and adjusted as desired. In this position, the carrying case 10 with the camera 22 restrained therein can be held or transported by a user until further use of the camera is desired. When the camera 22 is to be used, the camera 22 can simply be lifted out of the body portion 12 with or without disengaging the safety strap 16, depending upon the size of the camera 22 or similar article. Alternatively, the camera 22 can be actuated while it is still within the body portion 12, depending upon the type of camera 22. The engaged strap 16 will assist in preventing the camera from falling out of the case 10 through the front end of body portion 12.

As FIG. 2 illustrates, in order to protect the camera 22 within the body portion 12 from foreign elements such as rain, dirt and the like, the shroud 14 can be pulled up over the camera 22 and the drawstring 46 can be pulled to gather the second end 42 of the shroud 14 to substantially close off the opening 44 of the shroud 14. The drawstring retainer 48 is utilized to maintain the shroud 14 in a desired position.

Accordingly, the shroud 14 substantially protects the camera 22 from foreign elements and assists in restraining the camera 22 within the body portion 12. To remove the camera 22, the drawstring retainer 48 is activated and the drawstring 46 is loosened thereby increasing the size of the opening 44. Thereafter, the camera 22 can be lifted out of the body portion 12 with or without disengaging the safety strap 16 as described above.

Modifications and variations of the present invention are possible in light of the above teachings. A specific dimension, material, or construction is not required so long as the assembled device is able to function as herein described. It is therefore to be understood that within the scope of the appended claims, the invention may be practiced otherwise than as specifically described.

What is claimed and desired to be secured by letters patent of the United States is:

1. A carrying case comprising:

a substantially rectangular shaped body portion for accommodating therein a video camera or the like, said body portion having a plurality of upstanding walls and being open to the exterior on at least its top side and one end thereof; and an adjustable disengageable safety strap connected to opposed walls and extending across at least one of said open top side and open end of said body portion for restraining the camera within said body portion.

2. The carrying case as defined in claim 1 including a substantially flexible shroud positioned proximate said open top side and one end of said body portion which is connected to said body portion and is selectively actuable to substantially cover and protect the interior of said body portion and assist in restraining a camera within said body portion.

3. The carrying case as defined in claim 2 wherein said shroud has an opening and includes a drawstring for drawing said opening closed.

4. The carrying case as defined in claim 1 including an adjustable shoulder strap connected to said body portion for suspending said body portion from the shoulder of a user.

5. The carrying case as defined in claim 1 wherein the remaining sides, bottom and end panels of said body portion are constructed of a substantially deformable material.

6. A carrying case for accommodating and protecting a camera or the like from foreign matter and shock while enabling easy removal of the camera from the carrying case comprising:

a generally rectangular shaped body portion having a bottom, two sides and one end panel, at least said top and one end of said body portion being open to provide access to the interior of said body portion from said top and end, each of said bottom, side and end panels being constructed of a substantially deformable member having a shock absorbing insert therein for absorbing shock transmitted to said body portion;

an adjustable disengageable safety strap having at least two ends, one of said ends being connected to a first side panel and the other end being connected to the side panel opposite said first side panel so that said safety strap spans at least one of said open top and said open end of said body portion; and a flexible shroud member, one end of said shroud member connected to said open periphery of said body portion along said open top and end, the other end of said shroud member being closeable with a drawstring so that a camera positioned within said body portion can be restrained therein by said safety strap and said shroud member and can be protected from foreign elements by drawing closed said drawstring of said shroud member to close off the interior of said body portion.

7. A carrying case comprising:

a generally rectangular U-shaped body portion having a bottom wall, an end panel and two side panels so that an open front and top are provided to peripherally enclose a camera or the like therein; and an adjustable disengageable safety strap connected to said side panels and extending across at least one of said open front and open top of said body portion for restraining said camera within said body portion.

8. The carrying case as defined in claim 7 including a substantially flexible shroud positioned proximate said open front and top connected to said body portion to selectively close said open front and top.

* * * * *